United States Patent [19]

Smith et al.

[11] 4,186,225

[45] Jan. 29, 1980

[54] METHOD OF COATING THE INTERIOR SURFACES OF A HOLLOW ARTICLE

[75] Inventors: Jack L. Smith, Lake in the Hills, Ill.; Leon W. Mitchell, New Milford, Conn.

[73] Assignee: American Can Company, Greenwich, Conn.

[21] Appl. No.: 888,924

[22] Filed: Mar. 22, 1978

Related U.S. Application Data

[63] Continuation of Ser. No. 711,580, Aug. 4, 1976, abandoned.

[51] Int. Cl.[2] ..... B05B 7/08

[52] U.S. Cl. ..... 427/233; 427/239; 118/DIG. 3; 118/318; 118/314; 118/313

[58] Field of Search ..... 427/236, 233; 118/314, 118/318, 313, DIG. 3

[56] References Cited

U.S. PATENT DOCUMENTS

| | | | |
|---|---|---|---|
| 3,640,758 | 2/1972 | Hogstrom et al. | 427/233 |
| 3,697,313 | 2/1972 | Stumphauzer et al. | 427/233 |
| 3,726,711 | 4/1973 | Hogstrom | 427/233 |
| 3,797,456 | 3/1974 | Hogstrom | 427/233 |

*Primary Examiner*—Sam Silverberg

*Attorney, Agent, or Firm*—Robert P. Auber; George P. Ziehmer; Ira S. Dorman

[57] ABSTRACT

Two spray coatings are successively applied, without an intervening curing step, to coat the inside surface of a shell for a two-piece can. This "wet-on-wet" coating technique utilizes zone spraying, wherein only the sidewall is covered during the first application, with the second coat being applied to all inside surfaces.

8 Claims, 2 Drawing Figures

METHOD OF COATING THE INTERIOR SURFACES OF A HOLLOW ARTICLE

This is a continuation of application Ser. No. 741,580 filed Aug. 4, 1976, now abandoned.

BACKGROUND OF THE INVENTION

Various techniques have in the past been employed to coat the interiors of hollow articles and, more particularly, the shell or body of two-piece metal cans. Typically, such coatings are applied from a spray nozzle, which is positioned adjacent the open end of the can shell for delivery of the coating material thereinto. However, the spray patterns of conventional spray nozzles are such that the resultant coatings tend to be nonuniform, thus requiring the over-spraying of certain areas of the can so as to provide a necessary minimum coating on other areas. The problem is particularly acute in the case of can bodies made by drawing and ironing either tinplated or tin-free steel and intended for use with carbonated beverages, since they require especially heavy, uniform, void-free coatings to prevent corrosion and product contamination.

While attempts have been made to improve upon the aforementioned spray pattern deficiencies (see, for example, the spray nozzle described in U.S. Pat. No. 3,737,108), so far as is known no presently available nozzle provides a spray pattern which is capable of uniformly covering, in a single operation, the interior surfaces of a can body having one open and one closed end. Consequently, it has been found necessary to apply the spray coating in two applications, with the initial coating being cured prior to the second spray application; without such curing, the combined weights of the two coatings, as heretofore applied, would cause them to run and sag, and to accumulate in the corners of the can.

While entirely satisfactory from the standpoint of producing good quality coatings within the can shell, such a "double coat" technique is rather inefficient, in requiring either two passes of the can shell through the spraying and curing apparatus, or a single pass through two spraying and curing stations. Thus, the technique is disadvantageous in that it entails high capital expenditures for equipment, excessive plant space, energy, manpower and materials; moreover, the can shells are subjected to possible abuse as a result of the amount of handling which the double-coat process may involve.

Accordingly, it is an object of this invention to provide a novel method for producing a relatively heavy, uniform and continuous coating on the interior surfaces of hollow articles.

It is also an object of the invention to provide such a method wherein the efficiency of the coating operation is maximized.

Another object of the invention is to provide such a method wherein capital expenditures, and requirements of space, energy, manpower and materials are minimized, without sacrifice to the quality of the coating produced.

A more specific object of the invention is to provide a novel method having the foregoing features and advantages, which method is particularly beneficial for the coating of can shells fabricated by drawing and ironing steel blanks.

SUMMARY OF THE INVENTION

It has now been found that the foregoing and related objects of the invention are readily attained in a method of coating the interior surfaces of a hollow article, comprised of a sidewall having one end open and an end wall closing the opposite end thereof, which method includes two spraying steps. In accordance therewith, a liquid coating material is sprayed into the article through the open end thereof to produce one deposit therewithin, which is confined substantially to the entire inside surface of the sidewall. Another deposit is produced within the article by spraying a liquid coating material thereinto through the open end thereof, so as to cover substantially the entire inside surface of both the sidewall and also the end wall. Finally, the initial solidification of both of the deposits is simultaneously effected.

Preferably, the "one" deposit is applied prior to the "another" deposit, and the spraying steps are effected while the article is rotated about its longitudinal axis, most desirably at a rate of rotation of about 1000 to 3000 revolutions per minute. It is highly advantageous that the spraying steps be of a duration of about 1 to 4 revolutions of the article, and that the temperature of the coating material, as applied, be between about 20° and 85° Celsius. Generally, each of the sprays will have a sector-shaped configuration, wherein the rates of material delivery will preferably vary from minimum values at the margins of the sector to a maximum value therebetween, with the maximum value of material delivery occurring along a radius which lies at a point which is about 65 to 95 percent of the total arc distance between the margins.

In the particularly preferred embodiments, the article employed is the body or shell for a two-piece drawn and ironed metal can, fabricated from steel and having a cylindrical sidewall. In such a method, the total weights of the coating material applied to produce the "one" deposit and the "another" deposit are desirably within the ranges of about 120 to 200 milligrams and 80 to 150 milligrams, respectively with no more than about 10 percent of the total weight of the material applied to produce the "one" deposit being applied to the end wall of the body. Most advantageously, the combination of the "one" deposit and the "another" deposit will produce a substantially uniform and void-free coating having an average distribution of from about 5 to 8 milligrams of coating material per square inch. Finally, the coating materials applied should have a viscosity of about 10 to 250 centipoises, and preferably about 15 to 50 centipoises, at the temperature of application.

DETAILED DESCRIPTION OF THE ILLUSTRATED EMBODIMENT

Figure 1:
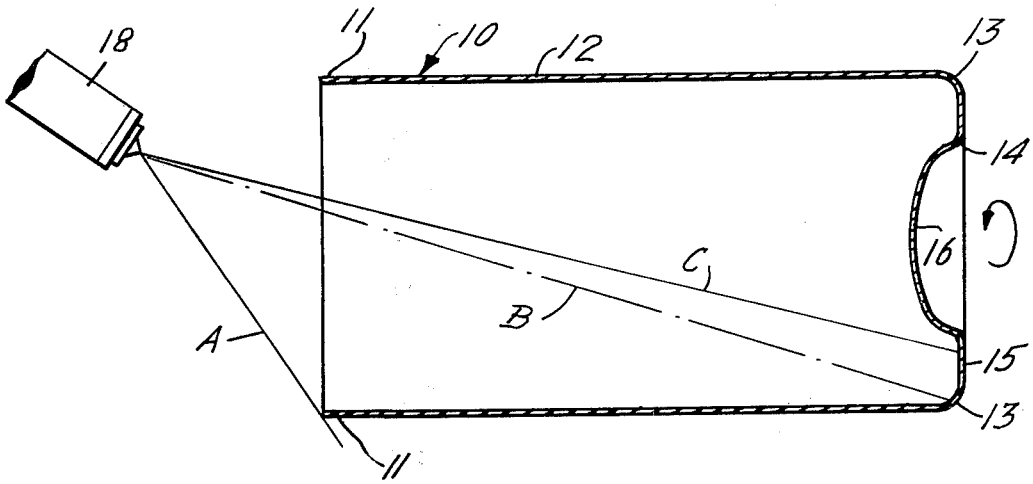
FIG. 1 is a diagrammatical representation of the first spraying step of the method of the present invention, showing a spray nozzle and a can shell, the shell being in cross section and disposed to receive coating material from the nozzle.

Turning now in detail to the appended drawing, therein shown are the two spraying steps of the novel method embodying the present invention. Referring to FIG. 1, which illustrates the spraying step which is preferably effected first, a horizontally disposed, open-ended can body or shell, generally designated by the numeral 10, comprised of a generally cylindrical sidewall 12 and an integral end wall 14, is rotated about its longitudinal axis (by means not shown). While the shell 10 is rotated at least once, and preferably between one and four revolutions, a spray nozzle 18, positioned adjacent the open end of the shell 10, directs a spray of a liquid coating material into the open end of the can shell 10 to form a deposit which is confined substantially to the entire interior surface of the sidewall 12 of the shell 10.

Figure 2:
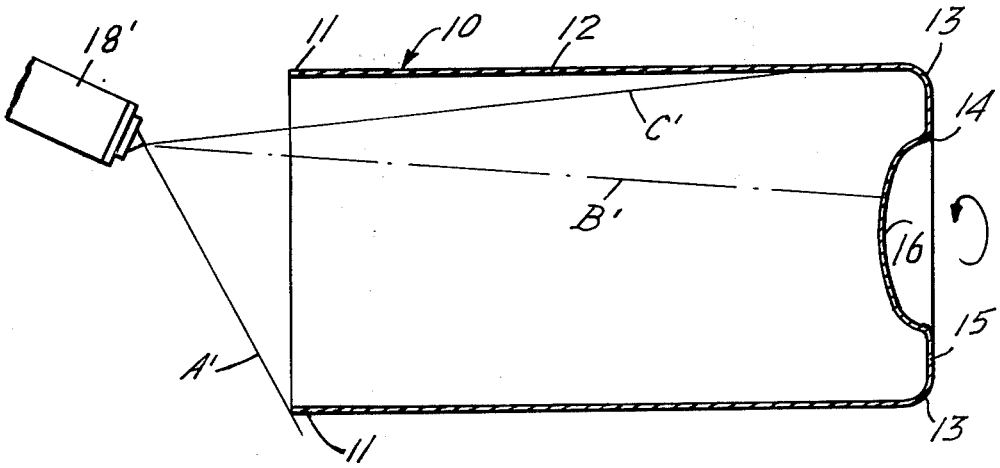
FIG. 2 is a view similar to that of FIG. 1, showing the second spraying step of the method.

Following the application of the first deposit, and while the shell 10 is still rotating, a second spray (of similar duration to that of the first application) is applied over the still wet or uncured first deposit. As illustrated in FIG. 2, the spray is directed into the open end of the can shell 10 from a second spray nozzle 18' to produce a second deposit which encompasses the entire interior surface of the shell 10, including both the sidewall 12 and also the end wall 14 thereof.

Finally, following the two spraying operations, the co-mingled "wet" coatings are cured, such as by subjecting the shell to elevated temperatures in an oven. It should be pointed out that, while there may be some casual drying of the coatings following each of the spray applications, there is no appreciable curing thereof prior to their exposure to the oven. Accordingly, their initial solidification may be regarded to be simultaneously effected, as a practical matter.

For each of the spraying operations depicted in the figures, the fan- or sector-shaped spray patterns of two preferred conventional spray nozzle orifices are illustrated, that of the controlled-distribution nozzle, in full line AC, A'C', and of the drumhead nozzle, in phantom line AB, A'B'. The drumhead nozzle orifice is designed to provide a fan-shaped spray pattern which has a maximum flow rate of coating material at (ideally) or closely adjacent one margin of the fan which decreases generally linearly to a point of minimum output at the other end or margin of the fan; the point of maximum flow is generally along a radius of the fan which is located at a point approximately 95 percent of the fan width or arc distance from one of the margins thereof and 5 percent from the other margin thereof. In contrast, the controlled-distribution nozzle provides a fan-shaped pattern having a maximum rate of flow at a point approximately 75 percent of the distance from one end of the fan and 25 percent from its other end; again, the flow rate decreases generally linearly from the point of maximum flow to the points of minimum flow, at each margin of the spray fan. The orifice designs and distribution patterns of these nozzles are more fully described and illustrated in U.S. Pat. No. 3,737,108, which is incorporated by reference herein.

Regardless of whether the drumhead or controlled-distribution nozzle is employed in the first spraying step (FIG. 1), each nozzle is oriented, relative to the can shell 10, such that the radius of their spray fan defining the point of maximum flow output is directed at the corner 13 of the can shell; this generally compensates, although not perfectly, for the increased distance the spray must travel to reach the corner 13. As a result of these nozzle orientations (most notably that of the controlled-distribution nozzle), parts of their spray fan will be directed at the annular flat surface 15 of the end wall 14. However, in neither case is there any appreciable coating accumulation on the end wall 14; generally, no more than about 10 percent of the total weight of the coating material applied in the first step.

For the second spraying step (FIG. 2), if a drumhead nozzle is employed, it is disposed relative to the shell 10, so as to produce a spray defined by margins A'B', which spray extends from the rim 11 of the shell 10 along the entire length of the sidewall 12 and onto the end wall 14 to a point slightly beyond the center of the central dome or dimple 16 thereof (to insure its full coverage). Alternatively, if a controlled distribution nozzle is used, it is preferred that it be disposed relative to the can shell 10 such that its spray A'C' extends beyond that of the drumhead pattern A'B', encompassing the entire end wall 14 as well as a portion of the opposite side of the sidewall 12 adjacent the corner 13. As can be appreciated, this provides added coverage to the bottom portion of the sidewall, an area of the can shell 10 which, regardless of whether the spray is directed at only the sidewall (i.e., AB or AC), or at the entire can interior (i.e., A'B' or A'C'), typically receives the least amount of spray coverage. Accordingly, a more uniform coating distribution is achieved.

Usually, each of the spraying steps will be completed in a single pass through a spraying machine. This may appropriately be accomplished by feeding a multiplicity of uncoated can shells to successive can-receiving pockets of a rotatable turret, which intermittently indexes the shells to a first and then to a second spray station, whereat they are rotated (such as by belts) while they receive the sprays from separately mounted nozzles. Thereafter, the coated shells are removed from the turret at a discharge station, for transfer to an oven in which curing of the coatings is effected.

In such a machine, the cans are preferably coated at the rate of 150 to 325 per minute, and are rotated at relatively high speeds, typically on the order of about 1000 to 3000 revolutions per minute, with the duration of each of the spraying steps being in the range of about 50 to 120 milliseconds and the duration between each of the spraying steps being in the range of about 75 to 250 milliseconds. Generally, the spray nozzles used will have a flow rate of about 0.09 to 0.16 gallons of water per minute at a pressure of 500 pounds per square inch, and the coating materials will normally be applied under a hydraulic pressure in the range of about 500 to 1200 pounds per square inch. Preferably, the first gun will apply a total weight of 120 to 200 milligrams of coating material, with the second gun applying a total weight of about 80 to 150 milligrams, so as to achieve an average distribution of between about five and eight milligrams per square inch over the entire interior surface of the shell.

Suitable coating materials for drawn and ironed container can shells fabricated from steel and intended for carbonated beverage use include, among other types of resins, epoxies, acrylics, and polyesters. These materials are preferably applied at a temperature within the range of about 20° to 85° Celsius, and they will normally have a viscosity in the range of about 10 to 250 centipoises at the temperature of application; preferably, they will exhibit viscosities of about 15 to 50 centipoises under that condition.

As a specific example, a shell for a two-piece drawn and ironed can, fabricated from tinplate and having an outside diameter of about two and eleven-sixteenths inches and a height of about four and thirteen-sixteenths inches, was coated in accordance with the instant method using two controlled-distribution nozzles employed in apparatus of the sort previously described. The first gun, used to apply the "sidewall" coat, was oriented downwardly at an angle of about thirty-five degrees relative to the horizontally disposed can shell, and was positioned at a distance of about one and one-quarter inches from the opening of the can shell with its orifice about one-half inch radically inward from the uppermost point of the can sidewall; its spray pattern was about seven inches wide, i.e., from margin to margin, measured at a point ten inches from the nozzle. The second gun, used to apply the "full" coat, was oriented downwardly at an angle of about twenty-five degrees from the horizontal and positioned at a distance of about one inch from the opening of the can shell with its orifice about three-quarters of an inch radially inward from the uppermost point of the can sidewall; its spray pattern was about ten inches wide, measured as described above. Each of the nozzles' flow rate was rated at 0.12 gallons per minute of water at 500 pounds per square inch and operated at a pressure of 800 pounds per square inch.

An epoxy-urea formaldehyde resin having a viscosity of about 20 centipoises was applied by each spray gun at a temperature of about 52° C. As the cans were rotated at about 1800 revolutions per minute, each coating was applied for about 100 milliseconds, or for about two and one-half revolutions of the can shell and the time between sprays was about 100 milliseconds. The first gun applied a total of about 180 milligrams, which provided an average distribution of about 5 milligrams per square inch on the interior surface of the side wall and about 0.5 milligrams per square inch on the annular flat interior surface 15 of the end wall 14. The second gun applied a total weight of about 120 milligrams, which provided an average distribution of about 2.5 milligrams per square inch on the sidewall, and about 7 milligrams per square inch and 7.5 milligrams per square inch respectively, on the annular flat surface 15 and the central dome 16 of the end wall 14; this resulted in a combined total weight for the two spray coatings of about 7.5 milligrams per square inch for the entire interior surface of both the sidewall 12 and the end wall 14. The can shell was then baked at about 216° C. for about two minutes.

While the instant method has been described in relation to the illustrated and preferred embodiment, it should be understood that modification may be made, as will be apparent to those skilled in the art. For example, while most advantageously the "sidewall" coat is applied prior to the "full" coat, their order may be reversed. It should also be mentioned that, although the fan-shaped spray patterns of nozzles having either a 75:25 or 95:5 flow distribution, are preferred, the maximum rate of material delivery may occur along a radius which lies at a point which is about 65 to 95 percent of the total arc distance between the fan margins.

It should be pointed out that, although it is preferred that the time between sprays be relatively brief, i.e., 75 to 250 milliseconds, considerably longer periods of time may be tolerated and, in fact, may be advantageous for certain applications. In addition, the coating materials applied in each spray need not necessarily be the same. Finally, it should be noted that, although the instant method is especially valuable for coating the inside surface of one-piece cylindrical shells or bodies for two-piece cans, and particularly for such shells fabricated from either tinplated or tin-free steel and intended to be filled with carbonated beverages, it may advantageously be employed for coating virtually any hollow article having a closed end.

Thus, it can be seen that the present invention provides a novel method for producing a uniform and continuous coating on the interior surfaces of hollow articles. In the method, the efficiency of the coating operation is maximized, and capital expenditures and requirements of space, energy, manpower and materials are minimized, without sacrifice to the quality of the coating produced. In particular, a novel method is provided having the foregoing features and advantages, which method is particularly beneficial for the coating of can shells fabricated by drawing and ironing steel blanks.

What is claimed is:

1. A method of coating the interior surfaces of a hollow one-piece container comprised of a generally cylindrical sidewall having one end open, and an end wall closing the opposite end thereof, said sidewall and end wall being integrally formed from a thin steel blank, comprising the steps of; spraying liquid coating material into said article through said open end thereof to produce one deposit therewithin, said one deposit being confined substantially to the entire inside surface of said sidewall and subsequently to produce another deposit, said another deposit covering primarily the entire inside surface of said end wall and the inside surface of said sidewall to produce a final deposit of substantially uniform thickness extending completely over said sidewall and said end wall, said spraying to produce each said deposit being effected for a period of about 1 to 4 revolutions of said container with said container being rotated about its longitudinal axis and with said coating material at a temperature of about 20°to 85° Celsius; and subsequently effecting the initial and concurrent solidification of both deposits to produce a substantially uniform, void-free coating.

2. The method of claim 1 wherein said one deposit is applied just prior to said another deposit and both deposits are applied before effecting solidification of either.

3. The method of claim 1 wherein the configuration of the spraying pattern employed to produce each said deposit is sector-shaped.

4. The method of claim 2 wherein the rates of material delivery within said sector-shaped spraying patterns vary from minimum values at the margins to maximum values therebetween, the maximum value of material delivery occurring along a radius which lies at a point which is about 65 to 95 percent of the total arc distance between said margins.

5. The method of claim 1 wherein said coating material has a viscosity in the range of about 10 to 250 centipoises at the temperature of application.

6. The method of claim 1 wherein said coating material has a viscosity in the range of about 15 to 50 centipoises at the temperature of application.

7. The method of claim 1 wherein the total weight of the coating material applied to produce said one deposit and said another deposit is about 120 to 200 milligrams and 80 to 150 milligrams, respectively, and wherein no more than about 10 percent of the total weight of the material applied to produce said one deposit is deposited on said end wall of said body.

8. The method of claim 1 wherein said one deposit and said another deposit cooperatively produce a substantially uniform and void-free coating having an average weight distribution of about five to eight milligrams per square inch.

* * * * *